US005397459A

United States Patent [19]

Butler

[11] Patent Number: 5,397,459

[45] Date of Patent: Mar. 14, 1995

[54] PROCESS TO PRODUCE LUBE OIL BASESTOCK BY LOW SEVERITY HYDROTREATING OF USED INDUSTRIAL CIRCULATING OILS

[75] Inventor: Kevin D. Butler, Sarnia, Canada

[73] Assignee: Exxon Research & Engineering Co., Florham Park, N.J.

[21] Appl. No.: 178,144

[22] Filed: Jan. 6, 1994

Related U.S. Application Data

[63] Continuation-in-part of Ser. No. 119,693, Sep. 10, 1993, abandoned.

[51] Int. Cl.[6] ..... C10M 175/00; C10G 45/00

[52] U.S. Cl. ..... 208/179; 208/142; 208/143; 208/144

[58] Field of Search ..... 208/142, 143, 144, 179, 208/18

[56] References Cited

U.S. PATENT DOCUMENTS

| | | | |
|---|---|---|---|
| 3,919,076 | 11/1975 | Cutler et al. | 208/180 |
| 3,980,551 | 9/1976 | Wolk | 208/179 |
| 4,033,859 | 7/1977 | Davidson et al. | 208/179 |
| 4,269,695 | 5/1981 | Silk et al. | 208/111 |
| 4,431,524 | 2/1984 | Norman | 208/183 |
| 4,512,878 | 4/1985 | Reid et al. | 208/179 |
| 4,810,365 | 3/1989 | Dohler et al. | 208/262 |

*Primary Examiner*—Anthony McFarlane
*Assistant Examiner*—Bekir L. Yildirim
*Attorney, Agent, or Firm*—Joseph J. Allocca

[57] ABSTRACT

Lubricating basestock oil suitable for use as such or as blending oil is obtained by the low severity hydrotreatment of industrial circulating oils of the type employed in low severity lubricating applications, and which have been mildly degraded and are no longer suitable for use for their intended purpose.

5 Claims, No Drawings

PROCESS TO PRODUCE LUBE OIL BASESTOCK BY LOW SEVERITY HYDROTREATING OF USED INDUSTRIAL CIRCULATING OILS

CROSS REFERENCE TO RELATED APPLICATIONS

This application is a continuation-in-part application of Ser. No. 08/119,693, filed Sep. 10, 1993, now abandoned.

FIELD OF THE INVENTION

Used lube oil rerefining is typically a multi-step, energy intensive operation which, while recovering valuable lube oil molecules in the used lube oil, produces a product typically of lower quality than or of a smaller volume than the original base oil charge from which it is derived. The process of rerefining usually employs multiple steps, some of which, such as caustic treatment or vacuum distillation, produce a bottoms sludge material which can pose a disposal problem.

Rejuvenation of used lube oil by a simple, low intensity procedure with a minimum number of steps, to a high enough level for reuse in its original intended purpose or as high quality blending stock, improving the quality of the entire lube pool, is a desirable goal from technological, environmental and financial perspectives.

BACKGROUND OF THE INVENTION

U.S. Pat. No. 3,980,551 treats a waste lube oil with hydrogen in an ebullating bed of catalyst, then vacuum distills the product to produce a clean stock. An ebullating bed is used because prior art fixed bed treatment required vacuum distillation to remove metal containing sludge to prevent catalyst degradation in fixed bed operations.

U.S. Pat. No. 4,810,365 teaches hydrotreating of a used insulating oil when the used oil is contaminated with halocarbon compounds.

U.S. Pat. No. 3,919,076 teaches a process where a light, saturated hydrocarbon solvent is used to remove impurities such as high molecular weight additives, additive fragments, and oil oxidation products plus high density particulates from a used automotive lube oil or similar waste hydrocarbon oil. Subsequent hydrogenation is conducted under severe conditions of temperature and pressure.

U.S. Pat. No. 4,033,859 teaches a process wherein used oil, such as automotive crankcase oil, is pretreated by heating to above about 400°–800° F. while the system is maintained in the liquid phase at a pressure between 500–3500 psig for 15–60 minutes. A sludge containing insoluble degradation products, metallic compounds and water is separated by e.g., centrifugation, leaving a substantially ashless oil product which can be used as such or as a fuel oil or which can be further refined to produce a high quality lube oil.

THE PRESENT INVENTION

Used industrial hydrocarbon lubricating oils containing low levels of additives, and degraded only to the point of no longer being suitable for their intended use, are rejuvenated by a process involving their segregated collection and isolation from other lubricating oils such as crank case oils, followed by mild condition hydrotreatment.

Used industrial hydrocarbon lubricating oils, suitable for rejuvenation and reclamation by the present process, include those oils containing only relatively low levels of additives which are themselves often of the ashless variety.

The industrial lube oils which can be employed as the feedstock to those process are those used in low severity lubricating applications such as water, steam or gas turbine systems, compressors, electrical insulating equipment such as transformers, hydraulic systems, paper manufacturing machines, light duty gear boxes using liquid and not grease lubricants and other machinery where there is minimal or no metal to metal contact.

There is no real viscosity limitation on the industrial oil which can serve as feedstock to the present process, except that fluids with kinematic viscosity below about 2.5 centistokes at 40° C. are not useful as lubricants. There is also no viscosity index (VI) limitation on the feedstock. Conventionally processed mineral oils will typically have VI's up to about 110. Oils with VI greater than that will contain substantial amounts of synthetic hydrocarbons such as PAO or hydro-isomerized wax, or VI modifying additives such as polymethacrylates. All of these will be acceptable in the present process as feedstocks. Other high VI oils could be fully or substantially synthetic lubricants containing organic esters, such as di-esters or polyol esters. These will not harm or be deleterious to the process, but would be converted to very light materials which would be lost from the lube product. Thus a hydrocarbon/ester mixture would be acceptable, but a fully ester material would be of no value.

Such oils are candidates for the present process when they have been mildly degraded and just fail to meet product specifications. They can be processed alone or as a mixture in any ratio with other fully or partly refined lubricant base stocks. Non-hydrocarbon based lubricants—such as phosphate esters, poly-glycols, water based fluids, silica-based fluids, and fluoro-carbons—would not be suitable for this process. Greases would also not be suitable, even if dissolved in oil to make them fluid, because their soap components would deactivate and foul hydrogenation catalysts.

Such oils typically contain low levels of additives, e.g., 0.01 to 5.0 wt %, preferably 0.05 to 2.0 wt % additive loading. Such additives which are used in formulating industrial lubricating oils are usually employed to impart improved demulsibility, resistance to foaming, rust inhibition, oxidation resistance, wear resistance, and color stability. In special cases viscosity modifying additives are used at levels of up to 20%.

Ashless additives used in industrial and related applications typically can contain carbon, hydrogen, oxygen, nitrogen, sulphur, phosphorus, boron, silicon—and at the low levels used in lubricant products these should not adversely affect catalytic hydrogenation processes. These additives carry out the functions described above. As previously stated, viscosity modifiers are the only additives used at higher levels in some oils (up to 20%), but these are generally polymers which contain only carbon, hydrogen and oxygen and do not adversely affect the process.

Other additives contain metals such as calcium, barium, magnesium, zinc, copper and molybdenum which are not readily removed by catalytic hydrogenation, unless they adsorb on the catalyst. In the latter case they can act as catalyst "poisons", and thus are unacceptable in the process except at very low levels, as described below.

The degree of degradation of the feedstock is best defined by several properties commonly measured for used lubricants. Used lubricant industrial oils having degrees of degradation falling within the following ranges are appropriate candidates for treatment in the present process.

| Property | Limit (maximum) | Preferred Limit (maximum) | Unit |
|---|---|---|---|
| Total acid number | 5.0 | 2.5 | mg KOH/g oil |
| Sediment | 2.0 | 1.0 | volume % |
| Metals content (total-excluding iron, copper) | 150 | 70 | ppm |
| Iron content | 250 | 100 | ppm |
| Copper content | 75 | 40 | ppm |
| Chlorine content | 200 | 40 | ppm |

Iron and copper need to be considered separately since they are commonly present as a result of equipment wear, and they are not deleterious to the hydrogenation process at these low levels. Other metals could be additive degradation products or arise from wear. Phosphorus is often shown in elemental analyses of used oils, but is not a "metal", and is not deleterious to the process. The limit on chlorine is to avoid practical problems during processing, such as tower plugging and corrosion, arising from the production of hydrogen chloride.

The degraded industrial oil is kept segregated from other used oils, such as crank case lube oils, which contain high levels of metal, additive, oxidation, or wear contamination. Such severely degraded/contaminated oils are not amenable to the present process.

The segregated-degraded industrial oil is subjected to mild catalytic hydrotreatment. In some instances it may be desirable to subject the used industrial lube oil to a prefiltration step to remove fine solids and sludges which might otherwise plug or physically foul the catalyst.

Standard hydrotreatment catalysts, selected from the group consisting of Group VIB and non-noble Group VIII metals, as oxide or sulfide, and mixtures thereof on refractory metal oxide supports, are employed. Typical examples are cobalt/molybdenum (1–5% Co as oxide, 10–25% Mo as oxide), nickel/molybdenum (1–5% Ni as oxide, 10–25% Co as oxide) or nickel/tungsten (1–5% Ni as oxide, 10–30% W as oxide) on alumina or silica-alumina. Preferred catalysts are cobalt/molybdenum on gamma alumina (e.g. Crosfield 477) since they are less subject to fouling by oil contaminants. Nickel/molybdenum catalysts (e.g. KF-840) are somewhat more subject to fouling but still favorable for the process.

Hydrotreating is conducted under mild conditions which include a temperature in the range 200° to 325° C., preferably 240° to 290° C., most preferably 260° to 280° C., a pressure in the range 1.4 to 5.5 MPa, preferably 2.1 to 4.1 MPa, a space velocity in the range 0.25 to 5.0 LHSV, preferably 1.0 to 3.0 LHSV, at a hydrogen treat gas rate of 45 to 180 $Sm^3/m^3$, preferably 55 to 90 $Sm^3/m^3$.

The resulting re-refined industrial lube oil can be used by itself as a base stock suitable for re-additising for use in its original application. It can also be blended with virgin base stock or other re-refined stock for use in either its original application or other application commensurate with the total base stock characteristics. Alternatively it can be combined with untreated used oil to upgrade that used oil for use as heavy fuel. It is preferred, however, and most appropriate to employ the re-refined hydrocarbon lube oil produced in the present process as blending stock to formulate industrial oils suitable for re-use in the original intended or related purpose of the initial used lube oil feed stock.

The invention is demonstrated by the following non-limiting example.

EXAMPLE

A sample of used industrial steam turbine lubricating oil was secured. The oil was degraded in terms of its demulsibility (ASTM D1401 test), anti-rust (ASTM D665B test), and oxidation life (ASTM D2272 RBOT test) performances.

Three samples of this oil were subjected to mild hydro-treatment over KF-840 catalyst (Ni/Mo on alumina catalyst) under three sets of conditions. The conditions are recited in Table 1.

TABLE 1

PROCESSING CONDITIONS FOR HYDROFINING USED STEAM TURBINE LUBE OIL

| | SAMPLE NUMBER | | |
|---|---|---|---|
| | 1 | 2 | 3 |
| Catalyst | KF-840 | KF-840 | KF-840 |
| Mode | Upflow | Upflow | Upflow |
| Feed Rate, V/V | 1.5 | 1.5 | 1.5 |
| $H_2$ Treat Rate, $Sm^3/m^3$ | 72 | 72 | 72 |
| Pressure, MPa | 2.4 | 2.4 | 2.4 |
| Catalyst Hours | 451–469 | 475–493 | 500–518 |
| Temperature, °C. | 250 | 275 | 300 |

The performance of the used steam turbine lube oil is compared with the performance of fresh steam turbine lube oil and steam turbine lube oils prepared by readditising the three mildly hydrotreated reprocessed used oil samples.

These comparisons are presented in Table 2.

TABLE 2

PROPERTIES OF REPROCESSED USED STEAM TURBINE LUBE OIL

| Sample | Used Steam Turbine Lube Oil | 1 | 2 | 3 |
|---|---|---|---|---|
| Kinematic Viscosity @ 40° C. | 48.893 | 48.412 | 48.205 | 47.635 |
| Kinematic Viscosity @ 100° | 6.916 | 6.877 | 6.863 | 6.814 |
| Viscosity Index | 95.8 | 95.9 | 96.1 | 96.1 |
| Sulfur, wt % | 0.12 | 0.11 | 0.07 | <0.05 |
| Nitrogen, wppm | 49 | 35 | 29 | 23 |
| Total Acid No., mg/100 g | <0.2 | | | |
| Demulsibility (O/W/E(t))(ASTM D1401) | 3/24/53(30) | 40/40/0(10) | 41/40/0(10) | 41/40/0(15) |
| Color stability (1000 hr @ 100° C.) | | | | |
| initial color (ASTM) | L1.5 | L1.0 | L0.5 | L0.5 |

TABLE 2-continued

| PROPERTIES OF REPROCESSED USED STEAM TURBINE LUBE OIL | | | | | |
|---|---|---|---|---|---|
| final color (ASTM) | 7.0 | L3.5 | L3.0 | L3.0 | |
| | | Re-additised Reprocessed Oils | | | Additised |
| Formulated Oils | Used Oil | 1 | 2 | 3 | Fresh Oil |
| Demulsibility (O/W/E(t))(ASTM D1401) | 3/24/53(30) | 41/40/0(10) | 41/40/0(5) | 41/40/0(10) | 41/40/0(10) |
| Rust Performance (ASTM D665B) | fail | pass | pass | pass | pass |
| R.B.O.T., minutes (ASTM D2272) | 154 | 393 | 407 | 276 | 479 |
| Color stability (1000 hr @ 100° C.) | | | | | |
| initial color (ASTM) | L1.5 | L1.0 | L1.0 | L1.0 | L1.0 |
| final color (ASTM) | L6.5 | L2.5 | L2.0 | L2.0 | L3.0 |

As can be seen, rejuvenation, as evidenced by ASTM D2272 oxidation testing, goes through a maximum at a temperature of about 250°-275° C., all other conditions being held consistent. Thus, for this rejuvenation of used industrial oils to be effective, it is necessary that rejuvenation be performed under the mild hydrotreating conditions previously recited.

What is claimed is:

1. A process for rerefining used industrial hydrocarbon lubricating oils employed in low severity lubricating applications consisting essentially of collecting said oil separately from other used lubricating oils and catalytically hydrotreating said segregated industrial lube oil at a temperature in the range 200° to 325° C., a pressure in the range 1.4 to 5.5 MPa, a space velocity in the range 0.25 to 5.0 LHSV and a hydrogen treat gas rate of 45 to 180 $Sm^3/m^3$.

2. The process of claim 1 wherein the hydrotreating is performed at a temperature in the range 260° to 280° C., a pressure in the range 2.1 to 4.1 MPa, a space velocity in the range 1.0 to 3.0 LHSV and a hydrogen treat gas rate of 55 to 90 $Sm^3/m^3$.

3. The process of claim 1 wherein the used industrial lubricating oil contains about 0.01 to 5.0 wt % additive loading.

4. The process of claim 1 wherein the used industrial lubricating oil contains from 1 to 20 wt % viscosity modifying additive.

5. The process of claim 1 wherein the used industrial lubricating oil contains from 1 to 20 wt % viscosity modifying additive and from 0.01 to 5.0 wt % other additives.

* * * * *